US005362266A

United States Patent [19]

Brogdon

[11] Patent Number: 5,362,266

[45] Date of Patent: Nov. 8, 1994

[54] FLUSHMASTER FRESH WATER FLUSHING SYSTEM

[76] Inventor: Doug Brogdon, P.O. Box 18229, Panama City Beach, Fla. 32417

[21] Appl. No.: 79,877

[22] Filed: Jun. 23, 1993

[51] Int. Cl.[5] ..... F02B 77/00

[52] U.S. Cl. ..... 440/88; 137/543.013; 134/169 A

[58] Field of Search ..... 440/88, 900, 113; 134/166 R, 169 A, 167 R, 165 R; 114/222; 137/494, 541, 542, 543.13; 165/95; 123/41.14, 198 A

[56] References Cited

U.S. PATENT DOCUMENTS

| | | | |
|---|---|---|---|
| 3,001,546 | 9/1961 | Salisbury | 137/541 |
| 3,067,770 | 12/1962 | Fancher | 137/493 |
| 3,267,959 | 8/1966 | Savage | 137/516.11 |
| 3,441,044 | 4/1969 | Rodriguez | 137/111 |
| 3,756,273 | 9/1973 | Hengesbach | 137/540 |
| 4,083,399 | 4/1978 | Babish et al. | 134/169 A |
| 4,176,708 | 12/1979 | Joffe | 134/169 A |
| 4,276,914 | 7/1981 | Albertson | 134/169 A |
| 5,257,604 | 11/1993 | Vataru et al. | 134/169 A |

*Primary Examiner*—Edwin L. Swinehart
*Attorney, Agent, or Firm*—Franklin J. Cona

[57] ABSTRACT

A fresh water flushing system for a marine engine in a boat for use whether the boat is in or out of the water is disclosed. The system comprises a control panel mounted on the interior of the boat, a plurality of tubular "T" shaped interconnection fittings in a raw sea water cooling conduit, and a fresh water flush valve therebetween. The components are connected for fresh water fluid flow with a plurality of standard radiator hoses. The fresh water flush valve has a valve plunger for establishing fresh water flow between the control panel and the "T" shaped interconnection fittings. Further, the fresh water flush valve has a plurality of axial outlet ports to proportionately direct the flow of fresh water to the appropriate "T" shaped interconnection fitting in the raw sea water cooling conduit of the marine engine. A valve plug is provided to secure a positive closure when the fresh water flow is disconnected. The valve plug has a tapered body and an "O" ring to effect a positive seal and insure that no fluid backflow occurs when the flushing system is not in use and operation and the marine engine is operating under normal conditions in sea water. All of the fixed and movable parts are fabricated from material that resists salt air and salt water corrosion.

13 Claims, 9 Drawing Sheets

FLUSHMASTER FRESH WATER FLUSHING SYSTEM

BACKGROUND OF THE INVENTION

1. Field of the Invention

The present invention relates to a fresh water flushing system for marine engines, and in particular to a fresh water flushing system that expels entrained sea water from a raw sea water cooling conduit of the marine engine whether the boat is in the water or out of the water, and irrespective of whether the engine is running or is shut off.

2. Description of the Background Art

Throughout the United States efforts are being taken to improve fresh water flushing systems for marine engines. The primary object of the invention is to allow the operator of a motor boat to flush the salt water entrained in the engine after the motor is turned off. Fresh water flushing is recommended universally by every engine manufacturer. Flushing fresh water in a marine engine prolongs the life of the equipment, lowers the maintenance cost, and protects the significant investment in the engine itself.

Current systems treat the cooling system as a single cavity, as opposed to a group of cavities, water pathways, and equipment. Traditional flushing systems currently available are time consuming, prone to errors, and in many cases just not feasible to use for commercial crafts or pleasure crafts. For example, most flushing devices cannot be used if the boat is lifted from the water by a davit or stored in a boathouse. Current flushing equipment usually requires the engine to be running and the boat can not be in the water. Under certain conditions, flushing the engine can be hazardous. The current flushing systems have limitations on convenience and reliability that make them user unfriendly. Most current systems merely relocate salt and mineral residues to another location within the cooling system.

U.S. Pat. No. 3,441,044 issued to Rodriguez discloses a pressure responsive flush valve for flushing marine engines.

U.S. Pat. No. 3,001,546 issued to Salisbury discloses a check valve having tapered side walls and being responsive to pressure changes.

U.S. Pat. No. 3,067,770 issued to Fancher discloses a two-way pressure responsive flow valve having tapered side walls and further having a retaining cap with an "O" ring to effect a positive seal.

U.S. Pat. No. 3,267,959 discloses a check valve having a valve seal with an "O" ring mounted in an external groove and further having an inwardly tapered sidewall to engage the valve body to effect a proportional closing of the orifice in response to a pressure change.

U.S. Pat. No. 3,756,273 issued to Hangesbach discloses a valve plug having an axially tapered peripheral wall and an "O" ring oriented to form a tight seal when the pressure is reduced.

None of these previous efforts, however, provide the benefits intended with the present invention. Additionally, prior techniques do not suggest, the present inventive combination of component elements as disclosed and claimed herein. The present invention achieves its intended purposes, objectives and advantages over the prior art devices through a new, useful and unobvious combination of component elements, which is simple to use, with the utilization of a minimum number of functioning parts, at a reasonable cost to manufacture, assemble, test and by employing only readily available material.

Therefore, it is an object of the present invention to provide a fresh water flushing system to expel entrained sea water from a raw sea water cooling conduit of a marine engine whether the boat is in the water or out of the water.

It is a further object of the invention to provide a fresh water flushing system that works with a variety of marine engines including outboard engines, diesel engines, inboard/outboard engines (I/O), stern drive engines, jet skis, and the like.

It is a still further object of the invention to provide a fresh water flushing system that can be easily retrofitted into existing boats.

It is another object of the invention to provide a fresh water flushing system that proportions the flow of fresh water to each subsystem and component of the cooling system to insure correct filling and draining of harmful minerals and salts and other residues from the cooling system.

It is yet another object of the invention to provide a fresh water flushing system that can be easily incorporated as an Original Equipment Manufactured (OEM) component for newly manufactured boats.

It is a still further object of the invention to provide a fresh water flushing system that will resist the corrosive effect of salt air and sea water on the fixed and movable working parts of the invention.

It is yet another object to provide a fresh water flushing system that will not impair the operational performance of the marine engine when the fresh water flushing system is not in use and operation and the marine engine is operating on the water.

A final object of this invention to be specifically enumerated herein is to provide a fresh water flushing system in accordance with the proceeding objects and which will conform to conventional forms of manufacture, be of simple construction and easy to use so as to provide a device that would be economically feasible, long lasting and relatively trouble free in operation, and provide superior flushing performance.

Although there have been many inventions related to fresh water flushing systems none of the inventions have become sufficiently compact, low cost and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a fresh water flushing system for displacing sea water in a marine engine whether the boat is in the water or out of the water. The fresh water flushing system comprises a control panel mounted on an interior of the boat having a fresh water supply connection and a gate valve for regulating the flow of fresh water therethrough, a freshwater flush valve having an inlet port for receiving the flow of fresh water and a plurality of axial outlet ports for proportionately discharging the flow of fresh water, and a fresh water conduit therebetween. In addition, the system also has a plurality of tubular "T" shaped fittings interconnecting the fresh water flush valve to a raw sea water cooling conduit on the marine engine, and a plurality of flexible hoses therebetween for establishing fluid communication between each one of the axial outlet ports and one of the tubular "T" shaped fittings.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

DETAILED DESCRIPTION OF THE PREFERRED EMBODIMENT

Figure 1:
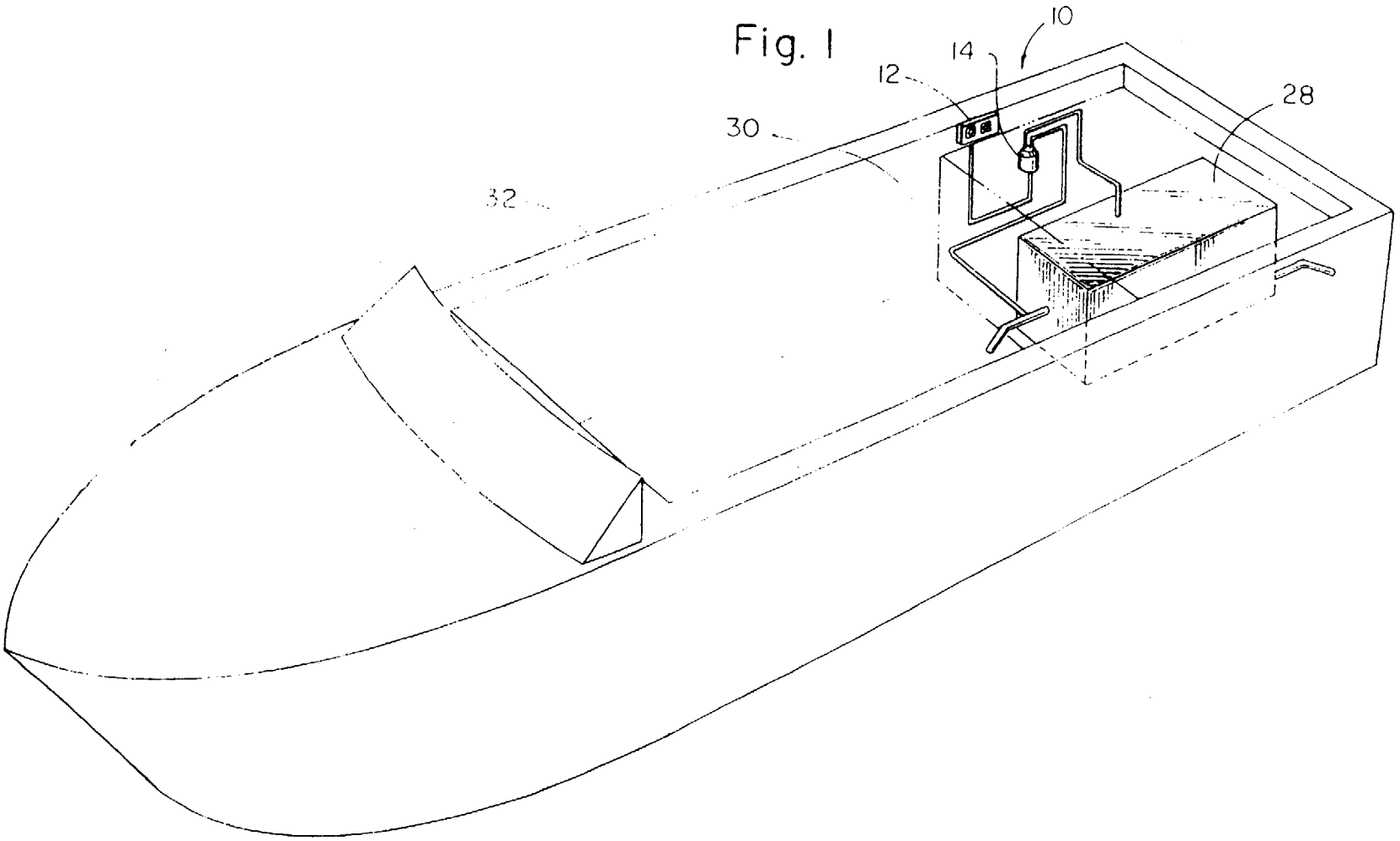
FIG. 1 is a perspective view of the invention in an inboard embodiment showing the relative location of the system to the inboard mounted engine.

Referring to FIG. 1, the invention 10 generally comprises a control panel 12, a fresh water flush valve 14, and a fresh water conduit 16 therebetween. In addition, a plurality of fresh water hoses 18,20 is interconnected between the fresh water flush valve 14 and a plurality of "T" shaped tubular interconnections 22,24 mounted in the raw sea water cooling conduit 26 of the marine engine 28.

Figure 2:
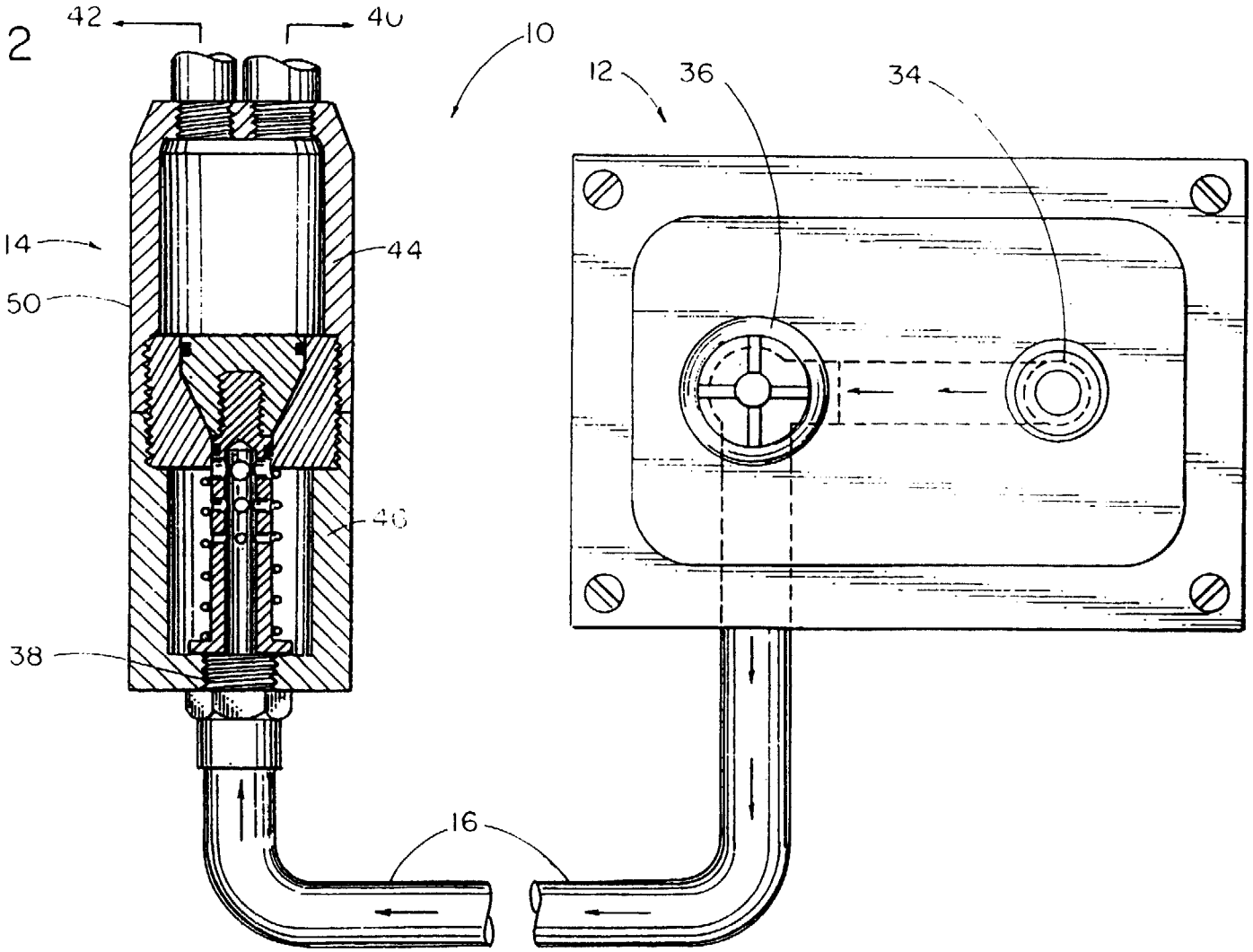
FIG. 2 is a conceptual flow schematic showing the control panel having a fresh water connection and a gate valve, and a fresh water proportioning flush valve in longitudinal cross-section, and a standard radiator hose therebetween.

As best seen in FIG. 1, the control panel 12 is mounted on an interior portion 30 of a boat 32, preferably in near proximity to the engine 28. Usually in a marina, fresh water is available dockside through a ½ inch hose outlet. Accordingly, the control panel 12 has a fresh water supply connector 34 adapted to receive a dockside source of fresh water, preferably a ½ inch threaded connection, as best seen in FIG. 2. The control panel 12 also houses a gate valve 36 for modulating the flow of fresh water through the fresh water conduit 16. The fresh water conduit 16 can be fabricated from any tubular material, preferably a standard ½ inch radiator hose.

Figure 5:
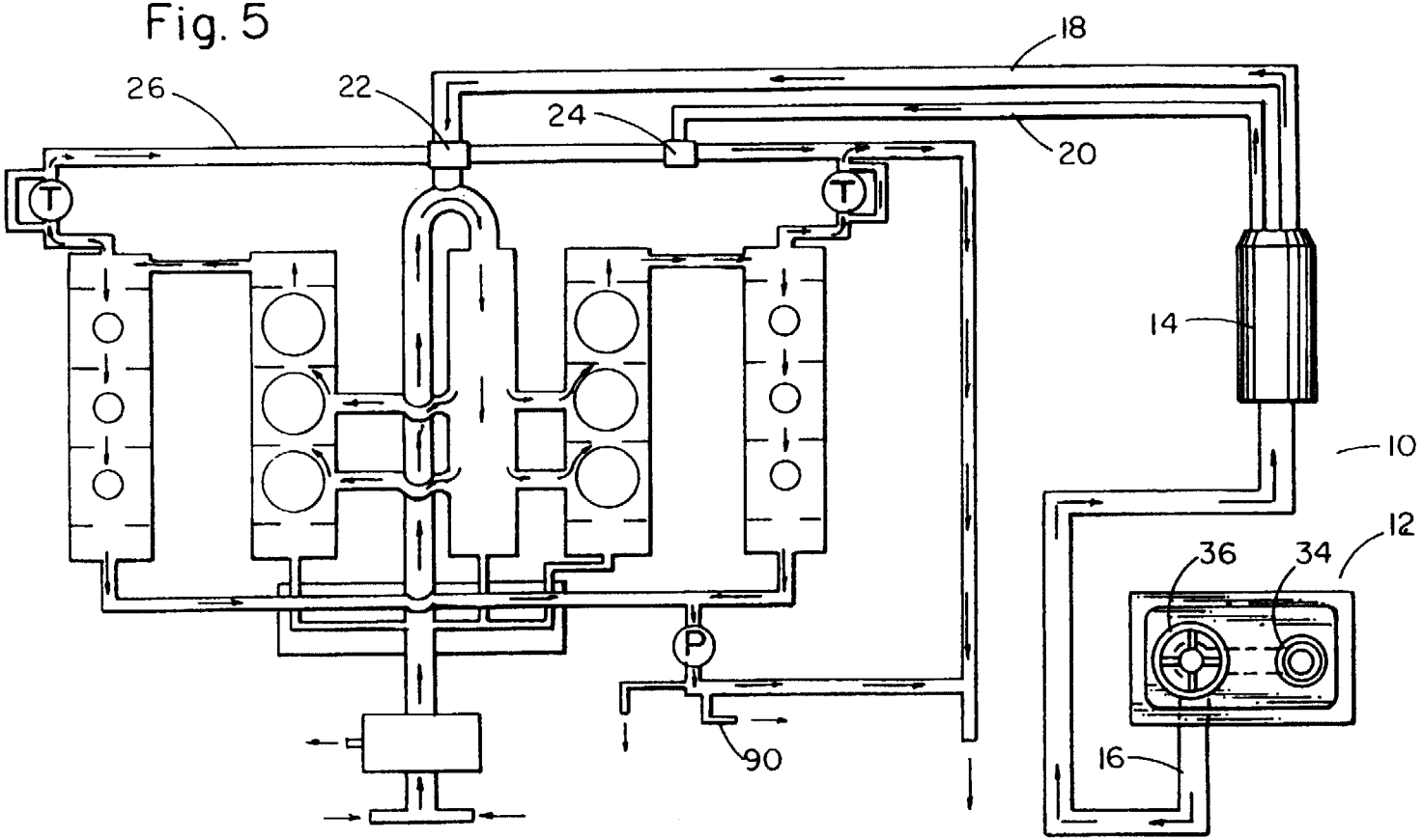
FIG. 5 is a conceptual flow diagram showing the interconnection of the proportioning flush valve system to a typical raw sea water cooling conduit for a typical outboard marine engine.
Figure 8:
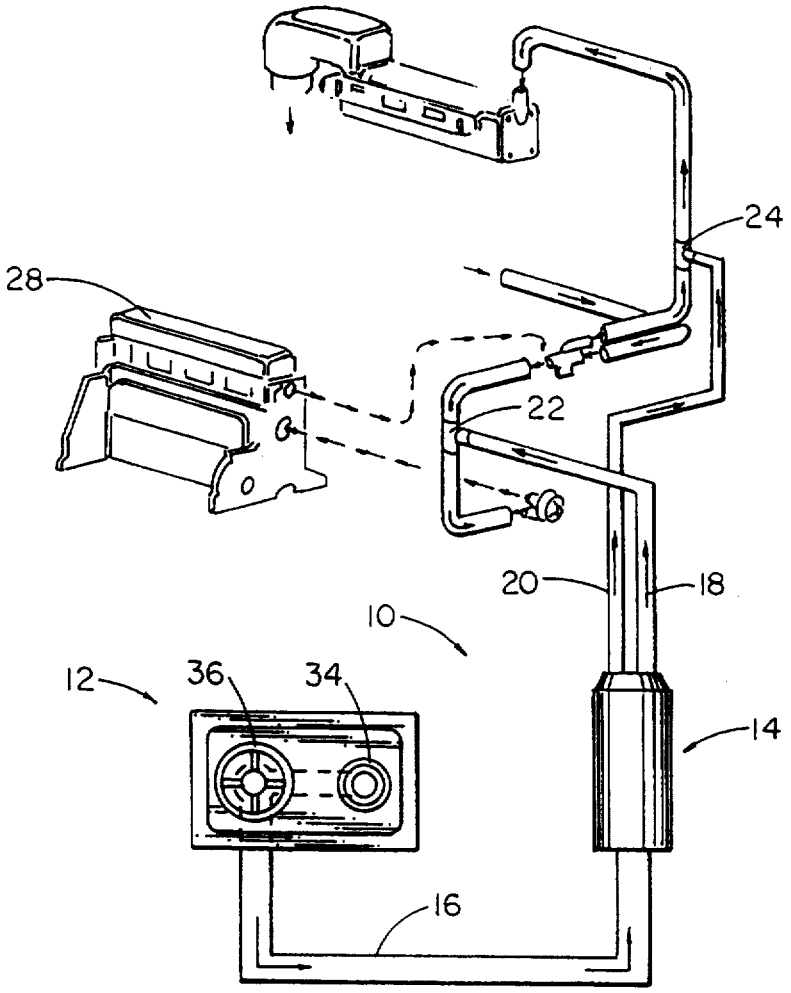
FIG. 8 is a conceptual flow diagram showing the proportioning flush valve interconnecting to the raw sea water cooling conduit of a typical four cylinder stern drive marine engine.
Figure 9:
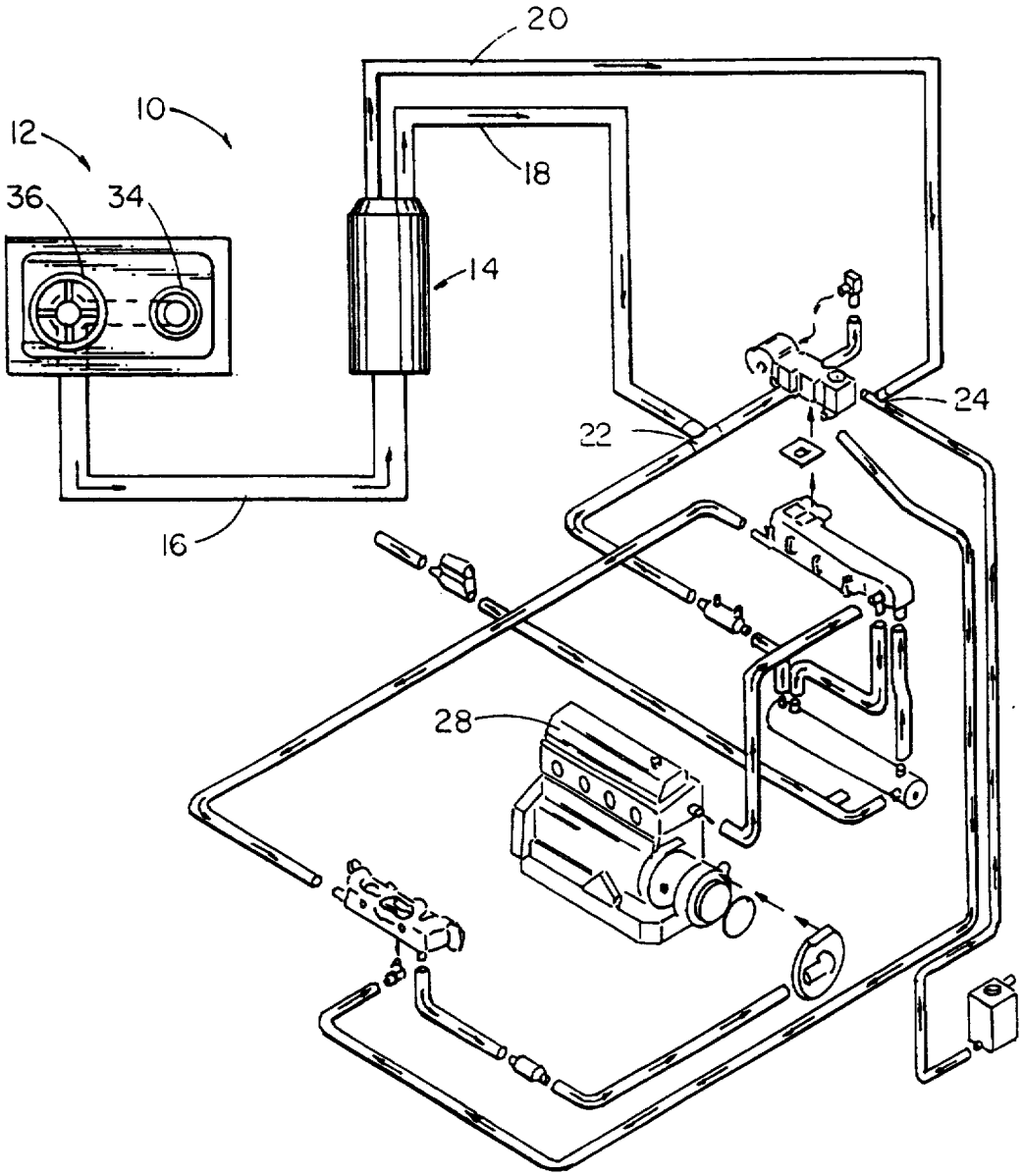
FIG. 9 is a conceptual flow diagram showing the proportioning flush valve interconnecting to the raw sea water cooling conduit of a typical four cylinder stern drive marine engine having a closed cooling system.

The fresh water conduit 16 interconnects the gate valve 36 and the fresh water flush valve 14. The fresh water flush valve 14 has an inlet port 38 adapted to threadably receive the fresh water conduit 16 and a plurality of axial outlet ports 40,42 adapted for threadable attachment to the fresh water hoses 18,20 respectively for establishing proportional fluid communication between each one of the axial outlet ports 40,42 and the tubular "T" shaped fittings 22,24 respectively in the raw sea water cooling conduit 26, as best seen in FIGS. 5 and 8. Each flexible hose 18,20 is secured to the raw sea water cooling conduit 26 with conventional non-illustrated hose clamps.

Figure 3:
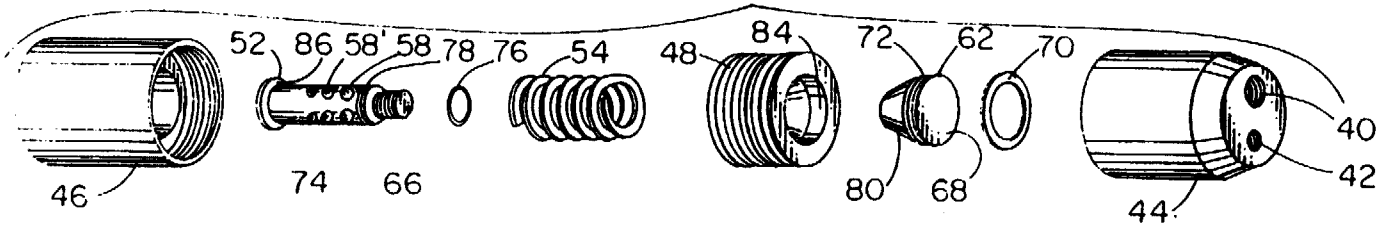
FIG. 3 is an exploded longitudinal perspective view of the proportioning flush valve showing the components of the flush valve prior to assembly.
Figure 4:
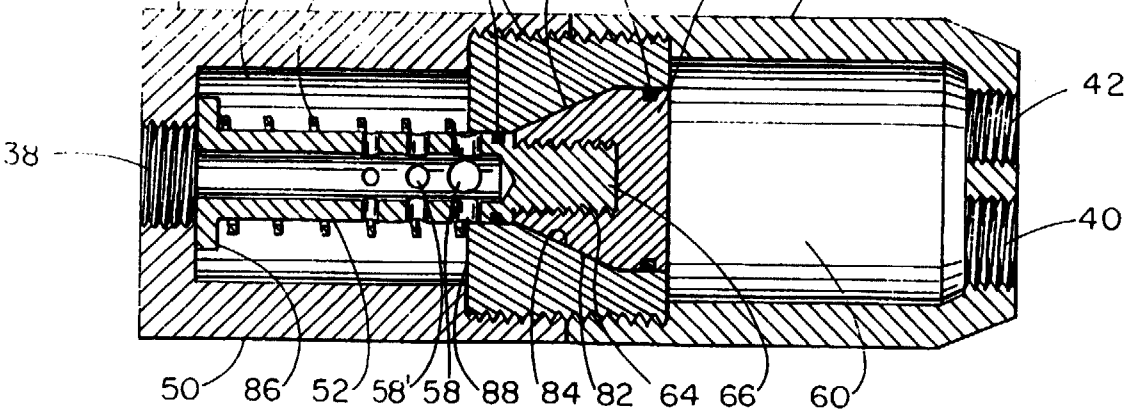
FIG. 4 is a longitudinal cross-sectional view of the proportioning flush valve showing in the assembled status.

As best seen in FIGS. 3 and 4, the fresh water flush valve 14 comprises an upper valve body 44 and a lower valve body 46 and a threaded nipple 48 therebetween. The upper valve body 44 and the lower valve body 46 are threadably adapted to receive the threaded nipple 48 for forming the outer shell 50 of the fresh water flush valve 14. The inlet port 38 in the lower valve body 46 is adapted to threadably receive the fresh water conduit 16 for establishing fluid flow communication between the fresh water conduit 16 and the fresh water flush valve 14. In addition, the lower valve body 46 houses a valve plunger 52 and a biased spring 54 in a cavity 56 therein. The biased spring 54 is disposed helically around the valve plunger 52 and circumadjacent the valve plunger 52 for responding to a change in fresh water pressure and transducing the pressure change to linearly displace the valve plunger 52 position from a normally closed position at zero fresh water pressure to a coiled biased open status when the fresh water pressure is sufficiently increased. The valve plunger 52 has a plurality of transverse discharge ports 58,58' for establishing proportional fresh water fluid flow through the fresh water inlet port 38 to an interior chamber 60 of the upper valve body 44.

A valve plug 62 having a recess 64 is in threadable communication with a first end 66 of the valve plunger 52 and is disposed within the threaded nipple 48. In this manner, any displacement of the valve plunger 52 results in an equal displacement of the valve plug 62. An upper portion 68 of the valve plug 62 has a first "O" ring 70 disposed on an outer periphery 72 to restrict backflow of fresh water to the control panel 12 when the flushing process is completed, or sea water when the flushing invention 10 is not in use or operation.

An upper portion 74 of the valve plunger 52 has a second "O" ring 76 disposed on an outer surface 78 above the transverse discharge ports 58,58' to further restrict backflow of fresh water to the control panel 12 after the flushing process is completed. Finally, a middle portion 80 of the valve plug 62 has a tapered shape forming a frustro-conical outer surface 82. The frustro-conical outer surface 82 engages an interior surface 84 of the threaded nipple 48 to still further close off backflow of fresh water to the control panel 12 after the flushing process is completed. In addition, the backflow restriction is important when the marine engine 28 is in use and operation on the high seas, and the invention 10 is inoperative. If backflow were to occur under normal operating conditions and the valve was not in a closed position, the sea water would infiltrate through the invention 10 and result in malfunction and possible harm to the occupants of the boat 32.

The spring 54 is in spherical biased communication with a plurality of shoulders 86,88 on the valve plunger 52 to maintain the valve plunger 52 in a normally closed position when the spring 54 is in an extended unbiased state. When the fresh water pressurizes the valve plunger 52, the valve plunger 52 moves linearly to establish fresh water fluid flow communication between the transverse discharge ports 58,58' and the interior chamber 60 of the upper valve body 44, and the spring 54 is compressed to a biased status.

When the fresh water pressure is relieved, the status of the spring 54 is reversed. That is, the spring 54 returns to an extended, normally closed status. The plunger 52 also returns linearly to its normally closed position and disconnects the fresh water fluid flow communication between the transverse discharge port 58,58' and the interior chamber 60 of the upper valve body 44.

The major advantage of the invention 10 over previous fresh water flushing systems is the ability to flush the entrained sea water from the raw sea water cooling conduit 26 without pulling the boat out of the water, or without having the engine 28 running. The boat owner can operate the invention 10 while the boat 32 is in a slip with the engine off.

Fresh water flushing is recommended universally by every engine manufacturer. The fresh water flushing of a marine engine prolongs the life of the equipment, lowers the maintenance cost, and protects the significant investment in the engine itself. This ease of operation will encourage more frequent flushing of the raw sea water cooling conduit 26 and hence, significantly increase the reliability of the engine 28 and the safety of the boat's occupants. Engine life will be increased significantly since corrosion of the engine 28 will be dramatically retarded.

The currently available systems for flushing a marine engine are time consuming, prone to errors, and in most cases just not feasible to use on commercial crafts or pleasure crafts. In most cases the flushing devices are useless if the boat is lifted out of the water by a davit and stored in a boathouse. Also, most current flushing systems require the engine to be running and cannot be used with the boat in the water. Most current system treat the cooling system as a single cavity. Actually, the modern marine engine comprises a water pick up and transfer system, a raw water circulating pump, a plurality of engine cooling passages, an intake head and manifold jacket, and an exhaust manifold. All of these subsystems and components require flushing after operation in salt water.

Figure 6:
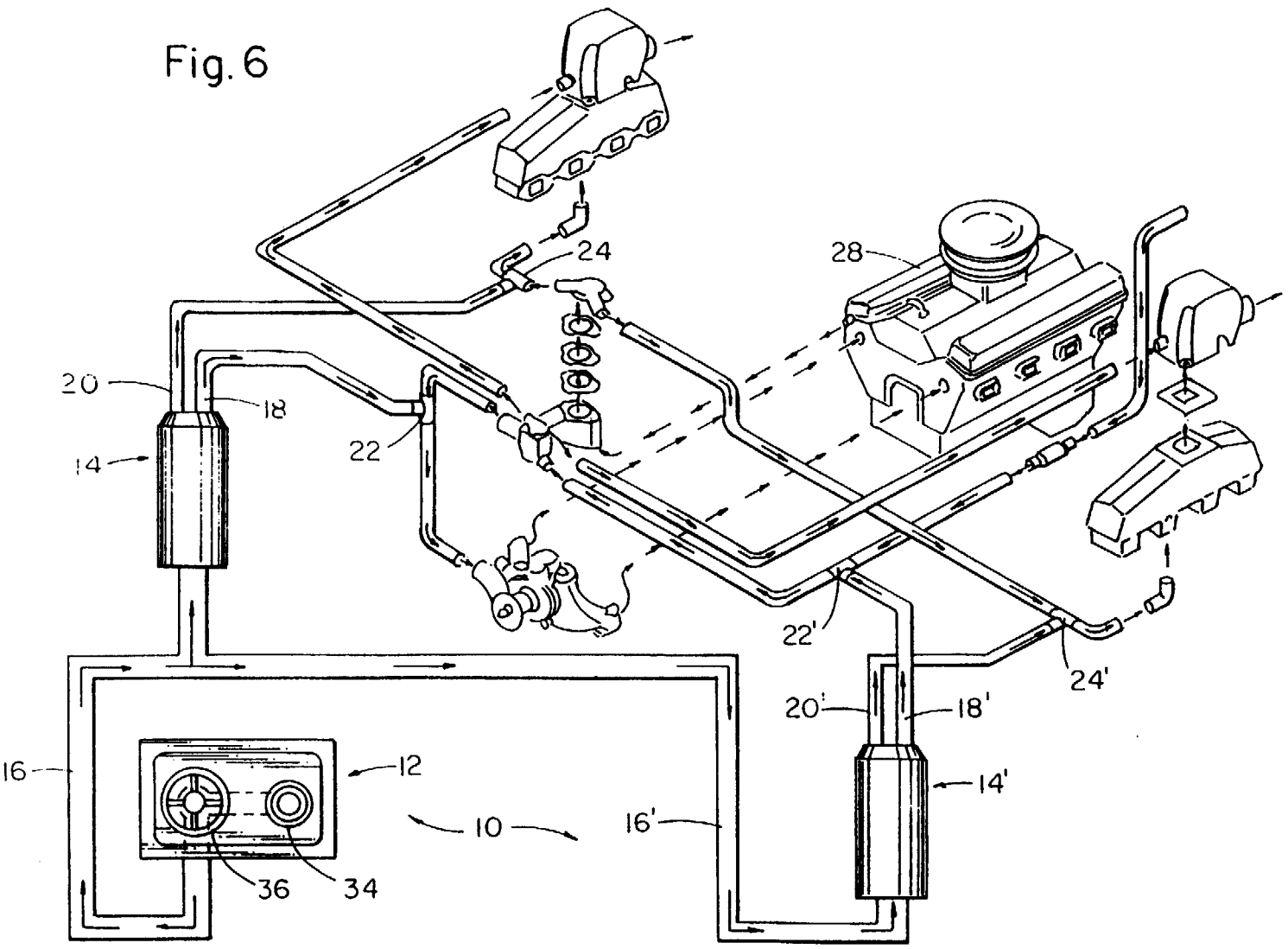
FIG. 6 is a conceptual flow diagram showing a plurality of proportioning flushmaster flush valves interconnecting to a raw sea water cooling conduit of a typical V-8 stern drive marine engine.
Figure 7:
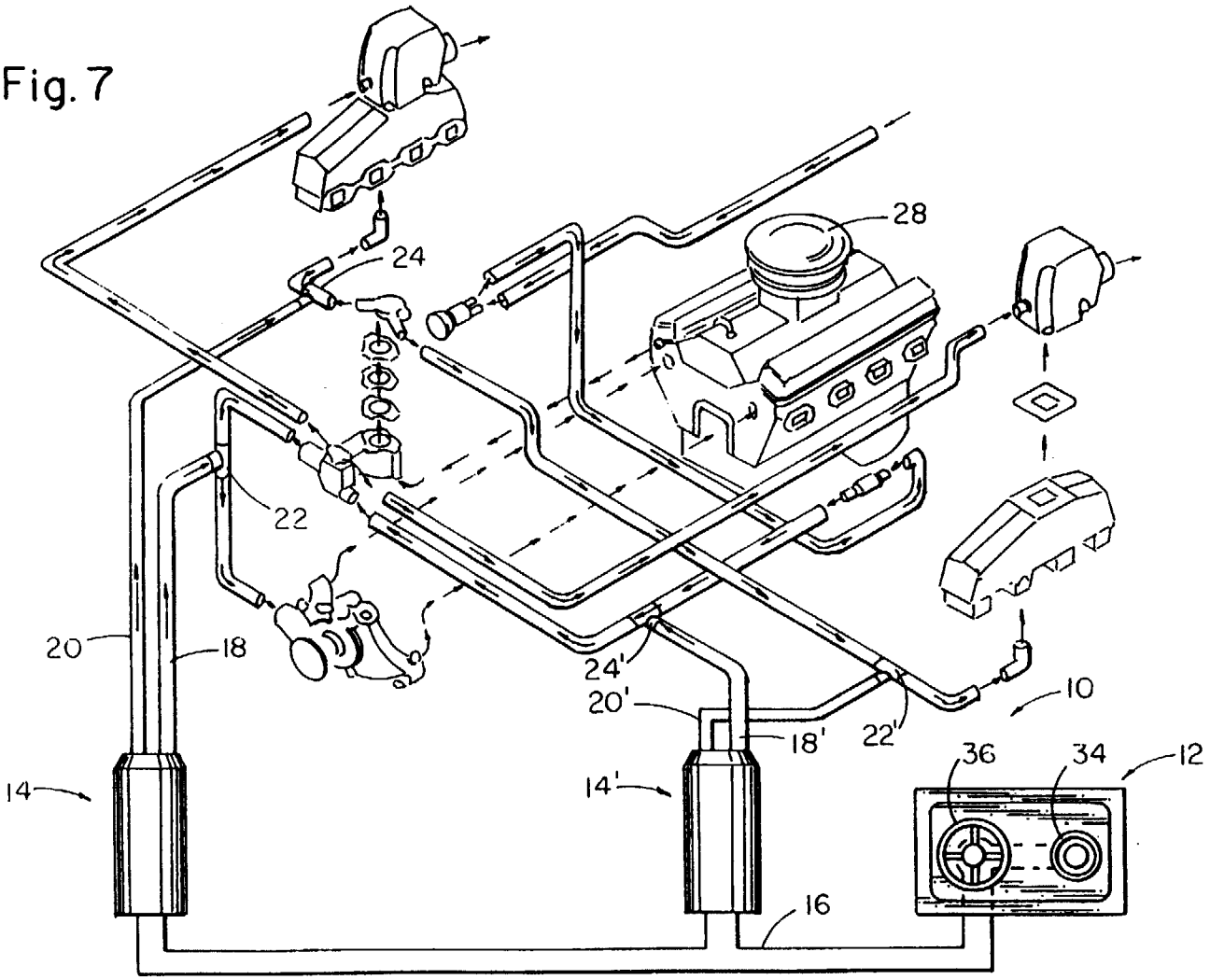
FIG. 7 is a conceptual flow diagram of the invention showing the plurality of proportioning flush valves interconnecting to the raw sea water cooling conduit of a typical V-8 inboard marine engine.

Certain types of engines, particularly inboard engines and sterndrive engines have very complex cooling systems. In the above cited cases, a plurality of flush valves 14 are deployed to properly proportion the fresh water flow to all of the engine cooling subsystems and components, as best seen in FIGS. 6 and 7.

In use and operation, the operator connects a source of fresh water to the fresh water supply connector 34 on the control panel 12. Then the gate valve 36 on the control panel 12 is rotated to an open position thereby establishing a pressurized fresh water flow to the fresh water flushing valve 14 through a fresh water conduit 16.

The fresh water flows through an inlet port 38 on a lower valve body 46 of the fresh water flush valve 14. The fresh water pressure moves a valve plunger 52 to an open status and the fresh water flows through an inlet port 38 and then through a plurality of discharge ports 58,58' disposed transversely on the valve plunger 52 into an interior chamber 60 of an upper valve body 44 of the fresh water flush valve 14.

Figure 10:
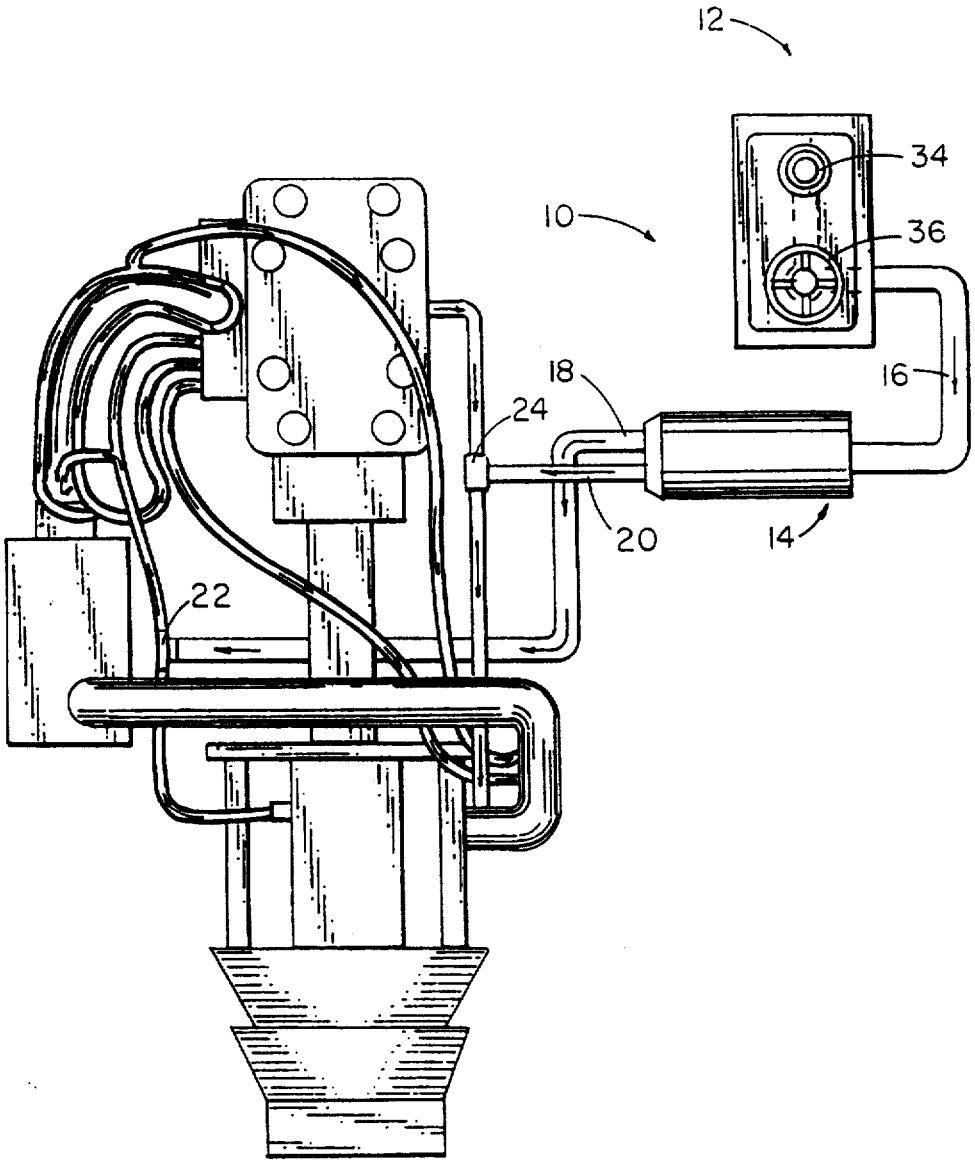
FIG. 10 is a conceptual flow diagram showing the proportioning flush valve interconnecting to the raw sea water cooling conduit of a jet ski marine engine. Similar reference characters refer to similar parts throughout the several views of the drawings.

The fresh water discharges from the upper valve body 44 through a plurality of axial outlet ports 40,42 and enters the raw sea water cooling conduit 26 through a plurality of "T" shaped tubular interconnections 22,24. The fresh water transits the raw sea water cooling conduit 26 and flushes the entrained sea water through a tell-tale nozzle 90 as best seen in FIGS. 5 and 10.

When fresh water is detected exiting the tell-tale nozzle 90, the operator closes the gate valve 36 on the control panel 12. The spring biased valve plunger 52 and the valve plug 62 then returns to a closed position as the pressure in the invention 10 returns to zero. The spring 54 extends to an uncoiled biased status and returns the valve plunger 52 to a closed position. The first and second "O" rings 70,76 respectively act harmoniously to disconnect the fresh water fluid flow communication and eliminate any backflow of fluid to the control panel 12. The fresh water flush valve 14 can be manufactured from any corrosion resistant material, preferably ABS or a thermoplastic. The "O" rings 70,76 respectively can be manufactured from any elastomeric material, preferably teflon.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of structures and the combination and arrangement of parts may be resorted to without departing from the spirit and scope of the invention.

Now that the invention has been described,

What is claimed is:

1. A fresh water flushing system for a marine engine in a boat for use whether the boat is in or out of the water comprising in combination:

A control panel mounted interiorly on the boat for housing a fresh water supply connector and a gate valve for regulating the flow of fresh water therethrough;

A fresh water flush valve having a fresh water inlet port for receiving the flow of fresh water and a plurality of axial outlet ports for discharging the flow of fresh water, each axial outlet port being sized for proportional flow of fresh water therethrough;

A first fresh water conduit therebetween adapted for urging fluid communication between the control panel and the fresh water flush valve;

A plurality of tubular interconnection fittings, each interconnection fitting having a "T" shape for urging proportional fluid communication between the fresh water flush valve and a raw sea water cooling conduit of the marine engine; and A plurality of hoses for urging fluid communication between each axial outlet port and each tubular interconnection fitting.

2. A fresh water flushing system as recited in claim 1 wherein the fresh water flush valve further includes an upper valve body and a lower valve body and an interior nipple therebetween, the upper valve body having an interior chamber and the plurality of axial outlet ports, and the lower valve body having a cavity having a valve plunger and a biased helical spring circumadjacent the valve plunger therein, and the fresh water inlet port.

3. A fresh water flushing system as recited in claim 2 wherein the valve plunger further includes a plurality of transverse discharge ports for urging passage of the fresh water from the fresh water inlet port to the interior chamber of the upper valve body.

4. A fresh water flushing system as recited in claim 1 wherein the interior nipple further includes a valve seal having a recess adapted for threadably receiving a first end of the valve plunger for urging equal motion of the valve plunger and the valve seal.

5. A fresh water flushing system as recited in claim 4 wherein the valve seal further includes a first "O" ring circumadjacent an upper portion of the valve seal for restricting liquid backflow to the control panel when the fresh water flushing system is not in use and operation.

6. A fresh water flushing system as recited in claim 2 wherein the valve plunger further includes a second "O" ring circumadjacent the valve stem and disposed on an upper portion of the valve stem above the transverse discharge port for restricting liquid backflow to the control panel when the fresh water flushing system is not in use and in operation.

7. A fresh water flushing system as recited in claim 4 wherein the valve seal further includes a middle portion having a frustoconical tapered shape for urging secure releasable engagement with an interior surface of the nipple for restricting liquid backflow to the control panel when the fresh water flushing system is not in use and operation.

8. A fresh water flushing system as recited in claim 2 wherein the valve plunger is fabricated from stainless steel.

9. A fresh water flushing system as recited in claim 5 or claim 6 wherein the first "O" ring and the second "O" ring are fabricated from a teflon elastomer.

10. A fresh water flushing system as recited in claim 2 wherein the valve plunger further includes a spring helically disposed and circumadjacent the valve plunger, the spring being biased for restricting fluid communication between the transverse discharge ports and the interior chamber of the upper valve body.

11. A method of flushing salt water in a marine engine in a boat whether the boat is in the water or out of the salt water comprising the steps of:

Connecting a source of fresh water to a fitting on a control panel;

Opening a gate valve on the control panel;

Flowing fresh water under pressure to an inlet port of a fresh water flush valve;

Moving a valve plunger to an open status within the fresh water flush valve;

Transferring the fresh water through a plurality of transverse discharge ports into an interior chamber of the fresh water flush valve;

Discharging the flowing fresh water proportionately through a plurality of axial outlet ports in an upper valve body of the fresh water flush valve;

Entering a raw sea water cooling conduit in the marine engine through a tubular fitting having a "T" shape;

Transiting the raw sea water cooling conduit for flushing the entrained sea water;

Exiting the raw sea water cooling conduit through a tell-tale nozzle;

Closing the gate valve on the control panel when the fresh water is detected exiting the tell-tale nozzle; and Returning the valve plunger to a closed status within the fresh water flush valve.

12. A method of flushing salt water from a marine engine as recited in claim 11 wherein the moving of the valve plunger further includes the step of biasing a spring for urging opening the valve plunger and extending the spring to a normal unbiased status for urging return of the valve plunger to a normally closed status.

13. A fresh water flushing system as recited in claim 1 wherein the fresh water flush valve further includes a plurality of fresh water flush valves for proportioning the supply of fresh water to more than two 'T' shaped interconnection fittings.

* * * * *